US005677057A

United States Patent [19]

Tashiro et al.

[11] Patent Number: 5,677,057

[45] Date of Patent: Oct. 14, 1997

[54] HEAT-BONDING CONJUGATED FIBERS AND HIGHLY ELASTIC FIBER BALLS COMPRISING THE SAME

[75] Inventors: Mikio Tashiro; Shigeru Hirano; Masayuki Hayashi, all of Matsuyama; Kazunori Orii; Makoto Yoshida, both of Osaka, all of Japan

[73] Assignee: Teijin Limited, Osaka, Japan

[21] Appl. No.: 692,720

[22] Filed: Aug. 6, 1996

[51] Int. Cl.[6] ..... D02G 3/00

[52] U.S. Cl. ..... 428/374; 428/397

[58] Field of Search ..... 428/374, 397

[56] References Cited

U.S. PATENT DOCUMENTS

| | | | |
|---|---|---|---|
| 4,115,621 | 9/1978 | Hawkins | 428/395 |
| 5,171,633 | 12/1992 | Muramoto et al. | 429/374 |
| 5,183,708 | 2/1993 | Yoshida et al. | 428/198 |
| 5,298,321 | 3/1994 | Isuda et al. | 428/362 |
| 5,352,518 | 10/1994 | Muramoto et al. | 428/374 |
| 5,505,815 | 4/1996 | Yoshida et al. | 156/512 |

FOREIGN PATENT DOCUMENTS

| | | | |
|---|---|---|---|
| 744112 | of 1944 | Germany | 428/374 |
| 60-1404 | 10/1977 | Japan . | |
| 0136831 | 8/1983 | Japan | 428/374 |
| 62-85026 | 4/1987 | Japan | D01F 8/14 |
| 4240219 | 1/1991 | Japan . | |
| 3185116 | 8/1991 | Japan . | |
| 5261184 | 8/1991 | Japan . | |
| 3220316 | 9/1991 | Japan . | |
| 4-222220 | 8/1992 | Japan | D01F 8/14 |
| 4316629 | 11/1992 | Japan . | |
| 5098516 | 4/1993 | Japan . | |
| 5163654 | 6/1993 | Japan . | |
| 5177065 | 7/1993 | Japan . | |
| 5302255 | 11/1993 | Japan . | |
| 5321033 | 12/1993 | Japan . | |
| 5337258 | 12/1993 | Japan . | |
| 6-184824 | 7/1994 | Japan | D01F 8/14 |
| 6272111 | 9/1994 | Japan . | |
| 6306708 | 11/1994 | Japan . | |

*Primary Examiner*—Newton Edwards

*Attorney, Agent, or Firm*—Sughrue, Mion, Zinn, Macpeak & Seas, PLLC

[57] ABSTRACT

Highly elastic heat-bonding conjugated fibers capable of providing a fiber structure having excellent recovery form compression and compression durability and a high level of air permeability comprise a thermoplastic elastomer component and a crystalline nonelastic polyester component having a higher melting point than that of the elastomer as constituent components thereof and can be provided by arranging the elastomer component in a crescent shape in the circular fiber cross section of the bonding conjugated fibers and specifying the geometrical dimensions (a shape occupied by each of the two components constituting the heat-bonding conjugated fibers) therein.

6 Claims, 1 Drawing Sheet

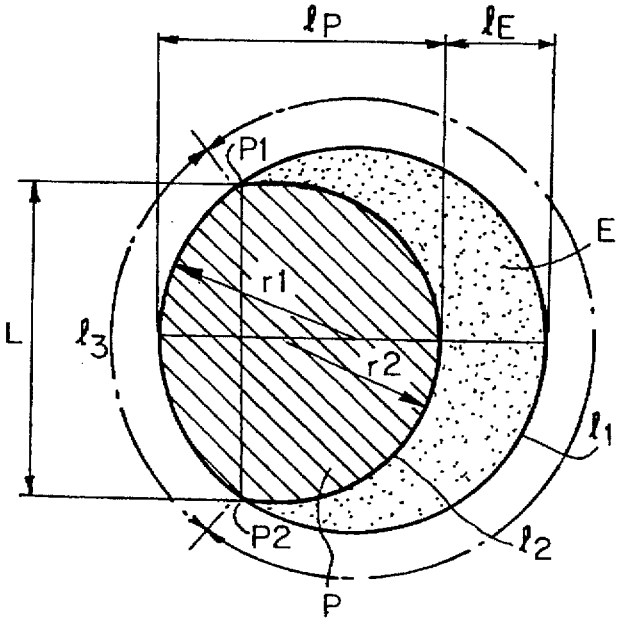
FIG. 1
FIG. 2(a)
PRIOR ART
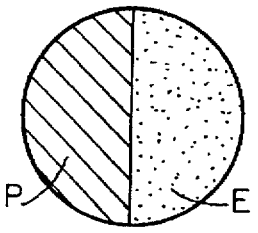
FIG. 2(b)
PRIOR ART
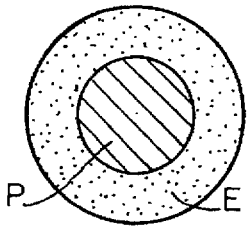
FIG. 2(c)
PRIOR ART
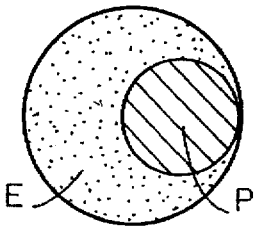
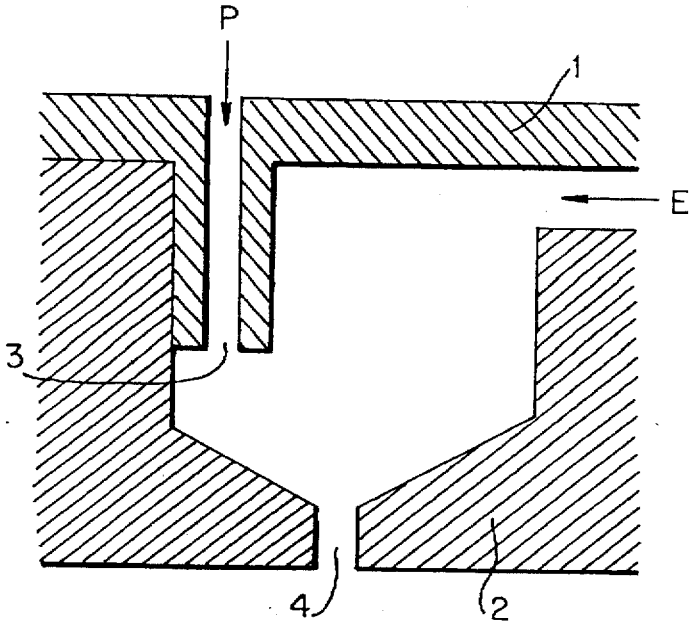
FIG. 3

HEAT-BONDING CONJUGATED FIBERS AND HIGHLY ELASTIC FIBER BALLS COMPRISING THE SAME

FIELD OF THE INVENTION

This invention relates to heat-bonding conjugated fibers and more particularly it relates to highly elastic heat-bonding conjugated fibers, causing a minimized cohesion phenomenon (undesirable) of the mutual fibers in steps after spinning and capable of providing a fiber structure with excellent elasticity, recovery from compression and compression durability and a high level of air permeability. The "cohesion phenomenon" herein described is a phenomenon in which mutual fibers physically and chemically stick together due to fusion, bonding, adhesion or the like. The fibers are mutually fused and contact bonded because of the "cohesion phenomenon" adversely affecting production and processing of the fibers.

BACKGROUND OF THE INVENTION

Japanese Patent Publication (KOKOKU) No. 60-1404 (1985) discloses highly crimp able conjugated fibers, produced by the conjugate spinning of a block polyester polyether and a nonelastic polyester consisting essentially of polybutylene terephthalate into a side-by-side type or an concentric sheath-core type and suitably usable as outer garments or underwear as conjugated fibers comprising a crystalline thermoplastic elastomer and a crystalline thermoplastic polyester. Japanese Laid-Open Patent Publication No. 3-185116(1991) discloses highly crimp able heat-bonding conjugated fibers, produced by the conjugate spinning of a polyester ether elastomer and a nonelastic polyester consisting essentially of polyethylene terephthalate into the side-by-side type or sheath-core type, readily openable by a carding engine and suitable for producing nonwoven fabrics with stretchability. Japanese Laid-Open Patent Publication No. 3-220316(1991) describes substantially concentric sheath-core type heat-bonding conjugated fibers having a polyester elastomer arranged as a sheath component and a nonelastic polyester arranged as a core component, improved in carding performance and spinning properties and useful for producing spun yarns and heat-bonding nonwoven fabrics. Furthermore, International Application Published under the Patent Cooperation Treaty W091/19032, Japanese Laid-Open Patent Publication Nos. 4-240219(1992), 4-316629(1992), 5-98516(1993), 5-163654(1993), 5-177065(1993), 5-261184(1993), 5-302255(1993), 5-321033(1993), 5-337258(1993), 6-272111(1994), 6-806708(1994) and the like disclose heat-bonding conjugated fibers having a thermoplastic elastomer arranged on the fiber surfaces and further fiber structures obtained by using the same.

The cross sections of the various heat-bonding conjugated fibers disclosed in the prior art set forth above are literally the side-by-side type and eccentric sheath-core type as shown in FIGS. 2(*a*) to 2(*c*). In these cases, the thermoplastic elastomer and nonelastic polyester are joined at an area ratio within the range of (20/80) to (80/20). By the way, in conjugated fibers using an elastomer as one component, a cohesion phenomenon of mutual conjugated fibers inevitably occurs due to the properties of the elastomer in the spinning step or thereafter causing various problems to occur. In this sense, none of the prior art with describe techniques for obtaining conjugated fibers with improved adhesion, elasticity and crimp ability while overcoming the cohesion phenomenon of mutual fibers nor suggest even the recognition thereof. Japanese Laid-Open Patent Publication No. 5-302255(1993) discloses, without regard to the presence of the recognition described above, the conjugate spinning of an elastomer, containing a large amount of a polyether component, with excellent elastic characteristics in spite of great cohesion properties and arranged as a core component and an elastomer, containing a small amount of the polyether component, with poor elastic characteristics in spite of slight cohesion properties as a sheath component in mutual conjugate spinning of polyester elastomers having different compositions into the sheath-core type and obtaining continuous filaments. However, preventing effects of cohesion at a practical level have not been obtained in conjugated fibers. Furthermore, conjugated fibers have uses of materials for nonwoven fabrics useful as cataplasma materials, interlining cloths, supporters, stretchable tapes and the like. Further, Table 1 shows the results of considerations for overall performance, i.e. the ability to prevent cohesion, interfacial adhesive strength between elastomer/polyester polymer, essential heat-bonding properties and crimp modulus of conventional heat-bonding conjugated fibers illustrated in FIGS. 2(*a*) to 2(*c*).

TABLE 1

| | | Conjugated Fiber (a) | Conjugated Fiber (b) | Conjugated Fiber (c) |
|---|---|---|---|---|
| Fiber Manufacturing Property | 1) Housing property of undrawn yarn in subtow can in spinning | Good | Bad | Bad |
| | 2) Yarn breakage in drawing | Slight | Many | Many |
| | 3) Discharge property of stuffing crimper | Good | Bad | Bad |
| Characteristics of Conjugated Fiber | 4) Ability to prevent cohesion in spinning | Great | Small | Small |
| | 5) Adhesive strength between elastomer/polyester (polymer interface) | Low (High)* | High | High |
| | 6) Thermal adhesive strength among filaments (No cohesion)** | (Low)** | (High)** | (High)** |
| | Cohesion | Low | Low | Low |
| | 7) Crimp modulus of elasticity | Low | High | High |

TABLE 1-continued

| | | Conjugated Fiber (a) | Conjugated Fiber (b) | Conjugated Fiber (c) |
|---|---|---|---|---|
| | 8) Three-dimensional crimpability | Great | None | Great |
| | 9) Opening property in opening step | Bad | Bad | Bad |
| Opening and Carding Performance | 10) Wrapping around card cylinder | Bad | Bad | Bad |
| | 11) Unevenness of card web | Bad | Bad | Bad |
| | 12) Card nep | Bad | Bad | Bad |
| Characteristics of Fiber Structure | 13) Compression resilence after heat treatment | Low (Due to low thermal adhesive strength) | Low (Binder characteristics cannnot be manifested due to great cohesion in spite of high thermal adhesive strength) | Low (Binder characteristics cannot be manifested due to great cohesion in spite of high thermal adhesive strength) |
| | 14) Hardness unevenness after heat treatment | Great (Great unevenness of hardness due to great unevenness of web) | Great (Great unevenness of hardness due to great unevenness of web) | Great (Great unevenness of hardness due to great unevenness of web) |
| | 15) Compression durability after heat treatment | Small | Small | Small |

Table 1 shows the results of a relative evaluation based on conjugated fibers (b), and "*)" in the table indicates a polyester elastomer. "**)" indicates an imaginary case in which of no cohesion occurs. As can be seen from tree results in Table 1, conjugated fibers (c) are excellent in 4 requirements of 5 prescribed properties [corresponding to 4) to 8) in the table], and they are considered as ideal fibers at a glance. However, "small", i.e. poor ability to prevent cohesion of the single filaments produces fatal disadvantages in the industrial production process or in the resulting products as described hereinafter. That is, the conjugated fibers are initially collected as undrawn yarns by winders or subtow cans. The following problems arise: Insufficient cooling causes cohesion due to the elastomer at the time of bundling mutual single filaments. However, even in a state of the undrawn yarns wound on Winders and stored, there are problems in that mutual cohesion of the single filaments proceeds to become a hard stringy form and subtows mutually firmly adhere and cannot be unwound from the winders. Even when the undrawn yarns are collected in subtow cans, there are problems in remarkably reduced amounts of the undrawn yarns housed in the subtow cans and a marked reduction in productivity due to the cohesion thereof into a stringy hard state. As mentioned above, subtows sticking together into the stringy form are extremely poor in drawability in the drawing step and yarn breakage or wrapping around roll stand units frequently occurs. Therefore, stable production cannot be performed. Even if heat-bonding fibers can be produced, the mutual fibers stick together as a mass. Because of this, the number of formed heat-bonded spots effective for bonding the mutual fibers is small in heat treatment in forming the fibers into a fiber structure such as a nonwoven fabric or the like and mixing thereof with other matrix fibers for use. Therefore, there are problems in that the adhesion is markedly low without any elasticity and the fiber structure is readily destroyed by external force with durability being lost. On the other hand, the ability of the conjugated fibers (a) to prevent cohesion is doubled as compared with that of conjugated fibers (b) or (c). The conjugated fibers (a), however, have problems of marked deterioration in heat-bonding functions and crimp modulus which are essential objects.

SUMMARY OF THE INVENTION

An object of this invention is to eliminate cohesion phenomenon, inevitably occurring in producing heat-bonding conjugated fibers containing a crystalline thermoplastic elastomer as one component and inhibiting the handleability of the fibers, process characteristics and further essential heat-bonding performance and to solve subjects which are conventionally left unsolved such as the coexistence of interfacial adhesive strength between polymers with essential bonding performance and crimp modulus. Furthermore, another object of this invention is to provide heat-bonding conjugated fibers giving cushioning materials or highly elastic fiber balls, having excellent blowing characteristics, bulkiness and recovery from compression and compression durability and having a soft handle and high elasticity. According to research the it has been found that above objects are a achieved and desired conjugated fiber are obtained by arranging an elastomer component in a crescent shape in the cross section of the heat-bonding conjugated fiber and specifying geometrical dimensions therein as follows:

That is, in this invention, the cross section and surface of the fiber are specified by the following requirements (1) to (5) in a conjugated fiber comprising a crystalline thermoplastic elastomer (E) and a crystalline nonelastic polyester (P) having a higher melting point than that of the elastomer (E) arranged in an area ratio E:P of (20:80) to (80:20) in the circular fiber cross section:

(1) the elastomer (E) is arranged in a crescent shape formed by two circular arcs having different curvature radii and a curve having a larger curvature radius ($r_1$) forms a part of the outer circumference line in the fiber cross section;

(2) the polyester (P) is joined to the elastomer along a curve having a smaller curvature radius ($r_2$) in the two curves forming the crescent shape and, on the other hand; the curve having the larger curvature radius ($r_1$) forms a part of the fiber surface in a circular arc form so as to provide an outer circumference line within a range of the circumference ratio R of 25 to 49% in the fiber cross section, with the proviso that the circumference ratio R is defined by the ratio of the outer circumference line ($L_3$) to the total circumference ($L_1$+$L_3$) thereof in the circle having the radius ($r_1$) in FIG. 1 and calculated by an equation R={($L_3$)/($L_1$+$L_3$)×100 (%)};

(3) the curvature radius ratio (Cr) which is the ratio ($r_1$/$r_2$) of the curvature radius ($r_1$) to the curvature radius ($r_2$) is within the range of 1 to 2;

(4) the bending coefficient C of the curve having the curvature radius ($r_2$) is within the range of 1.1 to 2.5 with the proviso that the bending coefficient C is defined by the ratio of the length of the circular arc ($L_2$) having the radius ($r_2$) to the length (L) between the contact points ($P_1$–$P_2$) formed by the circumference of the circle having the radius ($r_1$) and the circular arc ($L_2$) in FIG. 1 and calculated by an equation C=($L_2$)/(L) and (5) the wall thickness ratio D of the elastomer (E) to the polyester (P) is within the range of 1.2 to 3 with the proviso that the wall thickness ratio D is defined by the ratio of the length ($L_P$) of the polyester component (P) in the direction of a straight line passing through the center of the circle having the radius ($r_1$) and the center of the circle containing the circular arc having the radius ($r_2$) as a part thereof to the length ($L_E$) of the elastomer component (E) in FIG. 1 and calculated by an equation $$D=(L_P)/(L_E).$$

BRIEF DESCRIPTION OF THE DRAWINGS

FIG. 1. is a schematic drawing illustrating the fiber cross section of heat-bonding conjugated fibers of this invention;

FIGS. 2(*a*), 2(*b*) and 2(*c*) are schematic drawings illustrating the fiber cross sections of conventional heat-bonding conjugated fibers, respectively and FIG. 3 is a schematic drawing showing the vertical section of in conjugate spinneret for producing the heat-bonding conjugated fibers of this invention.

BEST FORM FOR WORKING THE INVENTION

The above-mentioned requirements (1) to (5) necessary to accomplish the objects of this invention are explained hereinafter in detail based on the drawings.

FIG. (1) shows one example of the section of the heat-bonding conjugated fibers (a true circle herein) solving the subjects of this invention. In FIG. 1, E denotes a crystalline thermoplastic elastomer, and P denotes a crystalline nonelastic polyester. Special features thereof are as follows: the component (E) is arranged in the crescent shape formed by two circular arcs having different curvature radii ($r_1$) and ($r_2$) in a circle having the curvature radius ($r_1$) in cross section, and the outer circumference line ($L_1$) thereof is the circular arc of the circle having the curvature radius ($r_1$) and directly constitutes a part of the fiber cross section. On the other hand, the component (P) is joined to the elastomer along the curve having the smaller curvature radius ($r_2$) in the two curves forming the crescent shape in the fiber cross section. The component (P) also forms a part of the fiber surface as indicated by the outer circumference line ($L_3$); however, the circumference ratio R of the outer circumference line ($L_3$) [R=($L_3$)/{($L_1$)+($L_3$)}×100 (%)]in the fiber cross section therein should be within the range of 25 to 49%, preferably 28 to 40%. When the ratio R is lower than 25%, filaments mutually tend to be fused or contact bonded in producing the conjugated fibers to give rise to cohesion, which easily causes difficulty in production. Furthermore, since the component (E) is soft, fibers bite in rotating garnet wires used for opening or mixing the fibers or are caught therein deteriorating carding performance. Therefore, long-term production becomes difficult or uniform mixed bulky fibers are only slightly obtained. Since the parts of the bonded part ($L_1$) are increased, heat-bonded spots to the surrounding fibers are increased to form a fine network structure and hardly develop the elasticity. On the other hand, when the R exceeds 49%, the area covered with the heat fusion component on the fiber surface is reduced in aspects of bonding functions to hardly cause desired bonding. In such a cross section, the curvature radius ratio Cr which is the ratio {($r_1$)/($r_2$)} of the curvature radii ($r_1$) to ($r_2$) should be higher than 1. When the value of Cr is 1 or below, the interface which is the joined line between both the components (E) and (P) is readily peeled. Once the interface is peeled, the thermal adhesive strength among the filaments is markedly deteriorated or the three-dimensional crimp ability is reduced to undesirably reduce the development of crimps. The crimp modulus of elasticity of the conjugated fibers is disadvantageously deteriorated to cause trouble such as defective opening in an opening step, frequent occurrence of wrapping around a card cylinder, occurrence of unevenness of card webs, formation of neps and the like. On the other hand, when the value of Cr exceeds 2, the area which is occupied by the component E based on the fiber cross section undesirably becomes too large. Next, in the above-mentioned conjugated form, the bending coefficient C related to the joining line of the components (E) to (P), i.e. the ratio {C=($L_2$)/(L)}of a perimeter ($L_2$) to the segment (L) connecting the points ($P_1$) to ($P_2$) should be within the range of 1.1 to 2.5, preferably 1.2 to 2.0 as shown in FIG. 1. When the value of C is lower than 1.1, the polymers tend to . peel mutually, and crimps are slightly developed or the development of crimps is reduced at the time of heat treatment in, for example, the conventional conjugated form as in FIG. 2(*a*). Therefore, flexible heat-bonded spots points rolling in nonelastic crimped stable fibers are hardly formed. On the other hand, when the value of C exceeds 2.5, the size of crimps is excessively increased or crimps in the heat treatment extremely readily occur to unfavorably reduce the bulkiness of the fiber structure or the like or produce a feeling of "GOROGORO" in handle. The feeling of "GOROGORO" herein is an scattered touch as if small hard foreign grain-like materials are present in the structure when the surface of the fiber structure is touched. Finally, the wall thickness ratio (D) of the components (P) to (E) is also extremely important. The ratio (D) is indicated by {D=($L_P$)/($L_E$)} when the length of the maximum wall thickness of the component (E) is ($L_E$) and length of the maximum wall thickness of the component (P) is ($L_P$) in FIG. 1, and the value of D should be within the range of 1.2 to 3.0, preferably 1.5 to 2.9. When the value of D is lower than 1.2, the crimps are slightly developed or the development of the crimps in the heat treatment is reduced. Similarly, it is undesirable because the resulting fibers are hardly converted into the fiber structure and fusion while rolling in nonelastic crimped staple fibers is hard to occur. When the value of D exceeds 3.0, it is undesirable because the size of crimps is excessively increased; crimps are extremely readily developed; the bulkiness or the like is reduced or the feeling of "GOROGORO" is produced in the handle. In invention, the component (P) preferably has a higher melting point than that of the component (E) by 10° to 190° C. Thereby, the component (P) is capable of maintaining the original fibrous form, holding the heat-bonded spots among mutual fibers, maintaining the thermal adhesive strength at a high level and improving the elasticity and compression durability by heat-treating only component (E) at a temperature of the melting point of component (E) or above and below the melting point of component (P) during heat-bonding the conjugated fibers. The component (P) is not especially limited herein as long as it is a polyester. Examples include a polymer composed of usual polyethylene terephthalate, polybutylene terephthalate, polyhexamethylene terephthalate, polytetramethylene terephthalate, poly-1,4-dimethylcyclohexane terephthalate, polypivalolactone or copolymer esters thereof. The polybutylene terephthalate hardly leaving a stress is preferred due to uses where repeated strain is applied thereto. Especially, when the hard segment of the elastomer also used in the fusing component of the conjugated fibers is polybutylene polymer, no special problems such as peeling occur and the polyester is good. The melting point of the component (P) is preferably within the range of 110° to 290° C. In contrast to this, the melting point of the component (E) is preferably 100° to 220° C. When the melting point is below 100° C., cohesion of mutual filaments in spinning cannot be completely prevented in some cases even when the spinning is carried out so as to satisfy the above-mentioned requirements (1) to (5) of this invention. When packed bales of the conjugated fibers are stacked in many stages in, for example, a storage house without any temperature conditioning apparatus in the summer, there is a fear that cohesion among the mutual fibers will occur. When the melting point exceeds 220° C., it is undesirably the utmost limit capacity of the stabilizing treatment temperature of a heat-treating machine with partially unevenness of thermal adhesive strength occurring and unevenness of hardness occurring. The melting point of the component (E) is more preferably within the range of 130° to 180° C. from aspects of prevention of cohesion or stability in heat treatment or the like.

Polyurethane elastomers or crystalline polyester elastomers are preferred as component (E) from the viewpoint of spinning suitability, physical properties or the like. Polyurethane elastomers include polymers obtained by reacting a low-melting polyol having a molecular weight of about 500 to 6000, for example, a dihydroxypolyether, a dihydroxypolyester, a dihydroxypolycarbonate, adihydroxypolyester amide or the like with aft organic diisocyanate having a molecular weight not higher than 500, for example, p,p-diphenylmethane diisocyanate, tolylene diisocyanate, isophorone diisocyanate, hydrogenated diphenylmethane diisocyanate, xylylene diisocyanate, 2,6-diisocyanatomethyl caproate, hexamethylene diisocyanate or the like and a chain-extending agent having a molecular weight not higher than 500, for example, a glycol, an amino-alcohol or a triol. Among the polymers, especially preferred are polyurethane elastomers prepared by using polytetramethylene glycol or poly-ε-caprolactone as the polyol. In this case, the preferred organic diisocyanate is p,p'-diphenylmethane diisocyanate and the preferred chain-extending agent is p,p'-bishydroxyethoxybenzene or 1,4-butanediol. On the other hand, crystalline polyester elastomers include polyether/ester block copolymers prepared by copolymerizing thermoplastic polyesters as hard segments with poly(alkylene oxide)glycols as soft segments. More specifically, the copolymers are preferably terpolymers composed of at least one dicarboxylic acid selected from aromatic dicarboxylic acids such as terephthalic acid, isophthalic acid, phthalic acid, naphthalene-2,6-dicarboxylic acid, naphthalene-2,7-dicarboxylic acid, diphenyl-4,4'-dicarboxylic acid, diphenoxyethanedicarboxylic acid, sodium 3-sulfoisophthalic acid and the like; alicyclic dicarboxylic acids such as 1,4-cyclohexanedicarboxylic acid and the like; aliphatic dicarboxylic acids such as succinic acid, oxalic acid, adipic acid, sebacic acid, dodecanedioic acid, dimer acid and the like and their ester-forming derivatives or the like; at least one diol component selected from aliphatic diols such as 1,4-butanediol, diethylene glycol, trimethylene glycol, tetramethylene glycol, pentamethylene glycol, hexamethylene glycol, neopentyl glycol, decamethylene glycol and the like or alicyclic diols such as 1,1-cyclohexanedimethanol, 1,4-cyclohexanedimethanol, tricyclodecanedimethanol and the like and their ester-forming derivatives and the like and at least one poly(alkylene oxide)glycol having an average molecular weight of about 300 to 5000, selected from the group consisting of polyethylene glycol, poly(1,2-propylene oxide)glycol, poly(1,3-propylene oxide)glycol, poly (tetramethylene oxide)glycol, ethylene oxide/propylene oxide copolymers and ethylene oxide/tetrahydrofuran copolymers and the like. From the viewpoint of physical properties such as adhesion to the polyester conjugated component, heat resistance characteristics, strength and the like, however, polyether/ester block copolymers in which polybutylene terephthalate serves as the hard segment and polyoxytetramethylene glycol serves as the soft segment are especially preferred as the crystalline polyester elastomers. In this case, the polyester portion constituting the hard segment is composed of polybutylene terephthalate having a copolymerization ratio (expressed in terms of mole % based on the total acid component) of terephthalic acid in an amount of 40 to 100 mole % based on the total acid component and isophthalic acid in an amount of 0 to 50 mole % based on the total acid component. Phthalic acid, adipic acid, sebacic acid, azelaic acid, dodecanedioic acid, 2,6-naphthalenedicarboxylic acid, 5-sodium sulfoisophthalic acid, 1,4-cyclohexanedicarboxylic acid and the like are preferably used as the acid component other than the terephthalic acid and isophthalic acid in order to provide a prescribed melting point and improve quality such as elasticity, durability and the like in particular, polyester elastomers containing 50 to 90 mole % of terephthalic acid and 10 to 35 mole % of isophthalic acid are more preferably used as the crystalline polyester elastomers. The main glycol component of the polyester portion is preferably 1,4-butanediol. The "main" herein described means that 80 mole % or more of the whole glycol component may be 1,4-butanediol or other kinds of glycol components may be copolymerized within the range of 20 mole % or below. The preferably used copolymerized glycol component includes ethylene glycol, trimethylene glycol, 1,5-pentanediol, 1,6-hexanediol, diethylene glycol, 1,4-cyclohxanediol, 1,4-cyclohexanedimethanol and the like. Furthermore, the polyether/ester block copolymers especially preferably have an average molecular weight of 800 to 4000 and contain 30 to 70% by weight of the glycol component in which 5 to 80% by weight of the poly(alkylene oxide)glycol component having an average molecular weight of 300 to 5000 is present. When the average molecular weight is lower than 300, the block properties of the resulting block copolymers are unfavorably deteriorated to result in insufficient elastic recovery performances. On the other hand, when the average molecular weight exceeds 5000, the copolymerizability of the polyalkylene oxide)glycol component is undesirably deteriorated to provide insufficient elastic recovery performance. In case the amount of copolymerized glycol component is less than 5% by weight, a cushioning material and the like good with elastic characteristics which are the object of this invention is not obtained even if the conjugated fibers are heat-bonded to form the cushioning material. On the other hand, when the amount of the glycol component exceeds 80% by weight, the mechanical characteristics and durability in heat resistance and light fastness of the resulting block co-polymers are disadvantageously deteriorated. The preferably usable poly(alkylene oxide)glycols include homopolymers of polyethylene glycol, poly(propylene oxide)glycol and poly(tetramethylene oxide)glycol. Furthermore, random copolymers or block copolymers in which two or more recurring units constituting homopolymers are copolymerized in a random or a block state or mixed polymers comprising two or more homopolymers or copolymers mixed therein may be used. The polyether/ester block copolymers can be obtained by using a well-known process for producing copolyesters. Components (E) and (P) are respectively dried to provide usually a moisture content of 0.1% by weight or below and then spun in producing the conjugated fibers of this invention. The process for joining the crystalline thermoplastic elastomer to the nonelastic polyester and producing the fibers can he carried out by using well-known spinning apparatuses and methods. By reference to the drawings, the conjugated fibers of this invention are obtained by using, for example, a conjugate spinneret as shown in FIG. 3. Component (P) in a molten state is made to flow from a pin 3 installed in the top plate 1 of the conjugate spinneret as shown in FIG. 3, and component (E) in a molten state is made to flow through a space between the top plate 1 and the bottom plate 2, joined to the component (P) and discharged from a nozzle 4 provided in the bottom plate 2. In spinning, a finish oil is applied to the resulting conjugated filament yarn obtained after discharging the polymer, quenching and solidifying the discharged polymer and the conjugated filament yarn can be taken off or subsequently drawn at a draw ratio of 2 to 5 times and taken off. The reason why conjugated fibers having the fiber cross section as shown in FIG. 1 are formed by using the spinneret as illustrated in FIG. 3 can be explained by the difference in melting point between the components (P) and (E). That is, the difference in melting point between both is directly related to melt viscosity. Therefore, component (P) has a higher melt viscosity (i.e. harder) and component (E) has a lower melt viscosity (i.e. softer) at the same temperature. That is, component (P) in the molten state flowing how from the pin 3 is hardly affected by the discharge pressure of component (E) in the molten state, flows directly in the vertical direction, come directly into contact with the bottom plate 2 while pushing away the surrounding component (E), further passes along the bottom plate 2 and is finally discharged from the nozzle 4 to thereby form the fiber cross section as shown in FIG. 1. An amorphous polyester-polyether block copolymer as the finish oil present among single filaments of the yarn before bundling just after spinning or during the bundling has remarkable effects as a means for preventing cohesion. Although the fibers are originally soft and have markedly poor in carding performance in improving the drawability of the conjugated fibers, passing the fibers through a card and forming the fiber structure at the same time, the amorphous polyester/ester block copolymer in an amount within the range of 0.02 to 5% by weight based on the fiber weight is employed to enhance the lubricity of the fibers and improve the wetability of the molten polymer in heat bonding. Thereby, thermal adhesive strength is increased and elasticity and compression durability of the fiber structure are remarkably improved. The pickup of the amorphous polyether/ester block copolymer at less than 0.02% by weight based on the fiber weight is insufficient to obtain effects of prevention of cohesion and improvement in carding performance and thermal adhesive strength. On the other hand, when the oil pickup exceeds 5% by weight, effects such as the prevention of cohesion and improvement in carding performance, thermal adhesive strength and the like are not obtained even if the pickup of the amorphous polyester-polyether block copolymer is further increased. The stickiness of the fiber surface is rather increased to cause sticking and wrapping in a card and the unevenness of hardness or the like undesirably occurs without providing a uniform fiber structure. Such an amorphous polyether/ester block copolymer is composed of terephthalic acid and/or isophthalic acid and/or m-sodium sulfoisophthalic acid or a lower alkyl ester, a lower alkylene glycol and a polyalkylene glycol and/or a polyalkylene glycol monoether thereof. Examples of the amorphous polyether/ester block copolymer include terephthalic acid-alkylene glycol-polyalkylene glycol, terephthalic acid-isophthalic acid-alkylene glycol-polyalkylene glycol, terephthalic acid-alkylene glycol-polyalkylene glycol monoether, terephthalic acid-isophthalic acid-polyalkylene glycol-polyalkylene glycol monoether, terephthalic acid-m-sodium sulfoisophthalic acid-alkylene glycol-polyalkylene glycol, terephthalic acid-isophthalic acid-m-sodium sulfoisophthalic acid-alkylene glycol-polyalkylene glycol and the like. The molar ratio of the terephthalic acid unit to the isophthalate unit or/and m-sodium sulfoisophthalate unit is preferably (100:0) to (50:50) so as to prevent close adhesion in spinning and bundling. Furthermore, the molar ratio of the terephthalate unit to the isophthalate unit or/and m-sodium sulfoisophthalate unit is especially preferably (90:10) to (50:50) so as to further increase the ability to prevent the conjugated fibers to which the block copolymer is applied from sticking together. In the block copolymer, the molar ratio of the terephthalate unit and isophthalate unit or/and m-sodiumsulfoisophthalate unit to the polyalkylene glycol unit is usually (2:1) to (1:51) and a ratio of (3:1) to (8:1) is especially preferred considering prevention of occurrence of close adhesion among single filaments in spinning and bundling, improvement in the adhesive strength among filaments and the like. The alkylene glycol used for producing the amorphous block copolymer is preferably an alkylene glycol having 2 to 10 carbon atoms such as ethylene glycol, propylene glycol, tetramethylene glycol, decamethylene glycol and the like and the polyalkylene glycol is preferably polyethylene glycol, polyethylene glycol-polypropylene glycol copolymer, polypropylene glycol-polytetramethylene glycol copolymer, polypropylene glycol and the like and further monomethyl ether, monoethyl ether, monophenyl ether and the like of the polyethylene glycol, polypropylene glycol and the like having an average molecular weight of usually 600 to 12,000, preferably 1,000 to 5,000. The especially preferred polyalkylene glycol is polyethylene glycol monoethers from the viewpoint of improvement in of preventing mutual single filaments from sticking together. The average molecular weight of the amorphous block copolymer is usually 2,000 to 20,000, preferably 3,000 to 13,000, depending on the molecular weight of the polyalkylene glycol used. An average molecular weight lower than 2,000 is insufficient to improve the drawability and thermal adhesive strength and prevent close adhesion. When the average molecular weight exceeds 20,000, the drawability and thermal adhesive strength are disadvantageously deteriorated. The polyalkylene, glycol used for regulating the molecular weight in polycondensing the block copolymer preferably has one blocked end group such as monomethyl ether, monoethyl ether, monophenyl ether or the like. The amorphous block copolymer is dispersed using a surfactant such as an alkali metal salt of a polyoxyethylene alkyl phenyl ether phosphate, an alkali metal salt of a polyoxyethylene alkyl phenyl ether sulfate and/or an ammonium salt, an alkanolamine salt thereof and the like. The flocculation starting temperature of the amorphous block copolymer dispersion is preferably 30 to 100%, more preferably 60 to 90%. The amorphous block copolymer is used in an amount of preferably 0.02 to 5.0% by weight, especially preferably 0.1 to 3.0% by weight based on the weight of the conjugated fibers. The size of the heat-bonding conjugated fibers of this invention is preferably within the range of 0.5 to 200 denier. When the size of the single fibers is smaller than 0.5 denier, the thermal adhesive strength is insufficient in heat-bonding thereof as the fiber structure and sufficient elasticity and compression durability are not obtained. When the size exceeds 200 denier, the yarn quenching of the filaments and the like is insufficient. Therefore, it is hard to prevent single filaments from mutually sticking together even by specifying the sectional shape as in this invention. As a result, the bonding performance of the filaments is deteriorated reducing the elasticity and compression durability. The size of the single filaments is especially preferably within the range of 2 to 100 denier. The conjugated fibers of this invention are drawn and then sometimes mechanically crimped by a stuff crimper; however, the number of crimps is preferably within the range of 5 to 25 peaks/inch and the percentage of crimp is preferably within the range of 5 to 30%. When the number of crimps is less than 5 peaks/inch and the percentage of crimp is lower than 5%, undesirable by a card web is broken in carding or the bulkiness of the fiber structure is markedly deteriorated. When the number of crimps exceeds 25 peaks/inch and the percentage of crimp exceeds 30%, the carding performance is unfavorably impaired with unevenness of webs and formation of neps occurring frequently. The number of crimps is especially preferably within the range of 8 to 20 peaks/inch and the percentage of crimp is especially preferably within the range of 6 to 18%. The cut length of the staple fibers at this time is preferably within the range of 10 to 100 mm, especially preferably within the range of 15 to 95 min. The heat-bonding conjugated fibers mentioned above themselves can solely be heat formed into a nonwoven fabric, a sheet and the like without regard to the shape of continuous filaments or staple fibers. The most preferred method is to disperse and mix the conjugated fibers in the form of crimped staple fibers in a fiber assembly containing nonelastic crimped polyester staple fibers as a matrix and heat form the resulting dispersion into a desired shape. This mode is typically disclosed in International Application Published under the Patent Cooperation Treaty WO91/19032 mentioned at the beginning. The nonelastic crimped polyester staple fibers to be the matrix may be any one if they have crimps in a helical or omega type or the form of, in part, helical or omega type. The nonelastic crimped polyester staple fibers include ordinary crimped staple fibers formed of usual polyethylene terephthalate, polybutylene terephthalate, polyhexamethylene terephthalate, polytetramethylene terephthalate, poly-1,4-dimethylcyclohexane terephthalate, polypivalolactone or copolymer esters thereof, blends of such fibers and conjugated staple fibers, having a right and left asymmetrically constituted side-by-side type fiber cross section, formed of two or more of the polymers in which the polymerization degree or copolymerization components of the polymer are changed and helical crimps and the like are developed. Conjugated fibers developing the helical or omega type crimps in drawing or heat treatment under relaxed conditions by isotropic quenching for strongly quenching one surface of the filaments in spinning thereof are also preferred, of course, so that crimps are developed. The cross-sectional shape of the staple fibers may be any of circular, flat, modified or hollow shapes. The crimped polyester stable fibers should be bulky even alone and compression resilience should be exhibited as a skeleton of the fiber structure. The sole bulkiness (according to JIS L-1097) should be preferably 35 $cm^3/g$ or above and 120 $cm^3/g$ or below under a load of 0.5 $g/cm^2$ and 15 $cm^3/g$ or above and 60 $cm^3/g$ or below under a load of 10 $g/cm^2$, more preferably respectively 40 $cm^3$ or above and 100 $cm^3/g$ or below and 20 $cm^3/g$ or above and 50 $cm^3/g$ or below. If the bulkiness is lower, problems arise such as a low elasticity or compression resilience of the resulting cushioning material formed of the fibers. The crimped staple fibers have a size thereof within the range of preferably 1 to 100 denier, more preferably 2 to 50 denier. When the size is smaller than 1 denier, bulkiness is not manifested and the fibers are compressed and hardly thoroughly and uniformly blown when blown into quilt fabrics with air or the like. Thereby, the resulting cushion material has poor cushioning properties or resilient power. When the size is larger than 100 denier, the fibers are hardly bent and converted into the fiber structure. The number of constituent fibers of the resultant fiber structure is excessively reduced with the handle hardening. The cut length thereof is within the range of preferably 10 to 100 mm, especially preferably 15 to 95 mm. The heat-bonding conjugated fibers of this invention are useful for obtaining highly elastic fiber balls. In this case, the weight blending ratio (%) of the heat-bonding conjugated fibers of this invention to the nonelastic crimped polyester staple fibers to be the matrix is preferably within the range of (5–49):(95–5). When the blending ratio of the heat-bonding conjugated fibers is too high, the number of the heat-bonded spots formed in the fiber balls is too large. Thus, the fiber balls are excessively hardened to cause problems in using thereof as a material for the cushioning material. Conversely, when the blending ratio of the conjugated fibers is too low, the number of the heat-bonded spots formed in the fiber balls is too small and the fiber balls are poor in shape stability. The surfaces of the nonelastic crimped polyester staple fibers are preferably treated with a lubricant and a readily slippery finishing agent. Since the surfaces are quite slippery, formation of the staple fibers into fiber balls with an air turbulent flow can be readily carried out. The handle of the resulting fiber balls is soft and a down or feathery touch handle is readily obtained. The lubricant may be any one if it becomes readily slippery by drying or hardening after application thereof. For example, surface friction can be reduced by coating the staple fibers with a segmented polymer of polyethylene terephthalate with polyethylene oxide. Furthermore, a finishing agent consisting essentially of a silicone resin such as dimethyl polysiloxane, an epoxy-modified polysiloxane, an amino acid-modified polysiloxane, methylhydrogenpolysiloxane, methoxypolysiloxane or the like as a silicone resin lubricant is also preferably employed in any stage to achieve a remarkable improvement in lubricity. The pickup of the lubricant is usually preferably 0.1 to 0.3% by weight. Since the addition of an antistatic agent the silicone resin or treatment with the antistatic agent after the treatment with the silicone resin is frequently necessary, of course, to prevent friction with air in forming the fibers into the fiber balls or prevent static electricity by high-temperature air turbulent treatment and the like in the fusing treatment, the antistatic agent, as desired, may be suitably added thereto. This lubricating treatment generally results in inhibition of heat bonding of the heat-bonding conjugated fibers to the nonelastic crimped polyester staple fibers. The heat-bonding conjugated. fibers specified by this invention are capable of relatively well fusing even to not only polymer-coated staple fibers comprising polyethylene terephthalate and polyethylene oxide but also crimped staple fibers to which the silicone resin is applied and morphologically moderately holding the nonelastic polyester staple fibers in a helical form to raise the apparent thermal adhesive strength. General heat-bonding conjugated fibers hardly have such actions of course. In this invention, the blending ratio of the nonelastic polyester staple fibers is preferably 95 to 51%, more preferably 90 to 55%. When the blending ratio is too high, the amount of the heat-bonding conjugated fibers is decreased to reduce heat-bonded spots. Therefore, the compression resilience is slight and the resulting fiber balls have poor shape stability. When the blending ratio is too low, the number of heat-bonded spots is too large and the fiber balls become too hard. There are problems in using the fibers as a material for cushioning materials. As described below, since the heat-bonded spots are formed from the nonelastic crimped polyester synthetic staple fibers while developing crimps, and the density of the fiber balls is undesirably raised. When the heat-bonding conjugated fibers of this invention are blended with the nonelastic crimped polyester staple fibers and formed into the fiber balls according to a method mentioned below, etc., in this invention, large amounts of the nonelastic staple fibers or feathers thereof are preferably present on the surface of the fiber balls. The feathers of the staple fibers contribute to the lubricity of the surface of the fiber balls and provide excellent blowing performances of the fiber balls or handle of the cushions after blowing the fiber balls thereinto. When the deformation is especially great (the especially great deformation herein refers to the deformation providing a thickness of, for example, 50% based on the thickness of the original wadding), an initial smooth touch due to the slipping of mutual adjacent fibers and a touch of increasing the elasticity and frictional force of heat-bonded spots formed by the elastomer is added thereto. As a result, good wadding in handle can be produced. Even if the large deformation as described above is repeated, the deformation of heat-bonded spots formed by the elastomer is recovered to thereby maintain elasticity and improve compression durability. As for a method for producing the highly elastic fiber balls, the nonelastic crimped polyester staple fibers are blended with the heat-bonding conjugated staple fibers of this invention so as to provide a prescribed blending ratio and opening and blending are thoroughly carried out with a card equipped with plural rollers having garnet wires stretched on the surface or the like so as to uniformly and sufficiently blend the fibers. Thereby, a bulky blended fiber mass is obtained. The blended fiber mass is then blown into a blower and turbulent stirring treatment of the blended fiber mass is carried out for a prescribed time to cause the fiber mass to stay in a vertical stream of air and be formed into balls while separating and opening individual staple fibers. Based on especially the characteristics of the conjugated staple fibers, crimping easily proceeds in the bulky blended fiber mass comprising the nonelastic crimped polyester staple fibers uniformly blended and entangled with the heat-bonding conjugated fibers to form quickly fiber balls while receiving air or a dynamic force. Furthermore, the fiber balls are heat-treated at a temperature of the melting point of the low-melting thermoplastic elastomer of the conjugated fibers or above and below the melting point of the polymer of the crimped polyester staple fibers to form heat-bonded spots in the fiber balls. Thereby, the fiber balls excellent in elasticity and compression durability and handle are obtained. Since the percentage of crimp is increased by heat treatment, the actions of the formed fiber balls are further produced. The highly elastic fiber balls of this invention may be produced by using any methods for initiating the actions and readily advancing the blling of the fibers. As mentioned above, the fiber balls are more easily formed with more lubricity and higher slipperiness of the nonelastic polyester staple fibers. The following methods, as desired, may be adopted of course: simultaneous promotion of the three of bailing of fibers, development of crimps and melting of the low-melting polymer and causing of fusion with hot air from the initial period of the treatment for bailing, initial treatment at normal temperatures in the initial period of bailing, blowing hot air at the time of starting the formation of nuclei for balling and causing the crimp development and fusion or carrying out the crimp development and fusion treatment with gentle hot air after complete bailing and the like. In particular, a mode in which the crimp ability of the nonelastic crimped polyester fibers is lower than that of the conjugated fibers; the nonelastic crimped polyester staple fibers are exposed to the surfaces of the fiber balls and the nonelastic crimped polyester staple fibers have smooth surfaces preferably provides the readily blown fiber balls with lubricity overall and blown cushions having good and soft handle.

EXAMPLES

This invention is explained in more detail by reference to the working examples hereinafter. In the examples, respective values were measured by the following methods:

Intrinsic Viscosity

A sample was dissolved in o-chlorophenol solvent at various concentrations [c](g/100 ml), and a value obtained by extrapolating data [$\eta$ sp (specific viscosity)/c]measured at 35° C. to zero concentration was recorded as the intrinsic viscosity.

Melting Point

A differential scanning calorimeter model 1090 manufactured by E. I. du Pont de Nemours and Co. was used to make measurements at a heating rate of 20° C./min to determine the peak temperature of fusion. When the peak temperature of fusion could not be distinctly measured, a melting-point apparatus for a trace sample (manufactured by Yanagimoto Mfg. Co., Ltd.) was used, and about 3 g of a sample was placed between two sheets of cover glass to raise the temperature at a heating rate of 20° C. /min while lightly pressing the sample with a pair of tweezers. Thereby, a thermal change in the polymer was observed. In the process, the temperature (softening point) at which the polymer softened and started to flow was recorded as the melting point.

Housing Properties of Undrawn Yarn in Subtow Can in Spinning

Undrawn yarns were initially housed in subtow cans in spinning and carried to the next creel step. The many undrawn yarns were then bundled and fed to the drawing equipment. The amount of yarns housed in subtow cans in Comparative Example 2 was regarded as 100%, and the amounts of undrawn yarns of other conjugated fibers housed in the subtow cans were compared therewith as a basis.

Yarn Breakage in Drawing

The drawing equipment was once stopped during the drawing of undrawn yarns to examine the number of broken single filaments of the drawn tow in the second hot water bath. The number of broken single filaments in Comparative Example 2 was regarded as 100%, and the number of yarn breakage of other conjugated fibers was compared therewith as a basis.

Discharge Properties of Stuffing Type Crimper

A drawn tow was fed to a stuffing type crimper and crimped to visually judge the discharge state of the tow from the crimper box. A case where the tow was naturally discharged from the crimper box without any problem was considered as excellent and a case where the tow was discharged from the crimper box without clogging the crimper box and the discharge was slightly irregular in spite of no difficulty in operation was regarded as good. A case where the crimper box was clogged with the tow without discharging thereof was judged as to be bad.

Ability to Prevent Undrawn Yarns from Sticking

The cohesion state of undrawn yarns just after spinning was visually judged. Where there was no mutual cohesion of filaments at all, the ability to prevent cohesion was regarded as excellent. Where some cohesion was present even though of a slight degree, the ability to prevent the cohesion was regarded as high. Where the yarns stuck together to form a hard wiry state, the ability to prevent the cohesion was judged to be bad.

Interfacial Adhesive Strength between Elastomer/Polyester

Fifty heat-bonding conjugated fibers of the product were randomly extracted to visually evaluate the interfacial peeled state between the elastomer/polyester in the fiber cross section thereof under an electron microscope. Where the number of fibers causing interfacial peeling was within 5, the interfacial adhesive strength was regarded as high. Where the number of fibers causing interfacial peeling was 30 or more, interfacial adhesive strength was considered as low.

Thermal Adhesive Strength among Filaments

The heat-bonding conjugated fibers were blended with hollow polyethylene terephthalate staple fibers, obtained according to a conventional method and having a size of 14 denier, a fiber length of 64 mm and a number of crimps of 9 peaks/inch at a weight ratio of 70:30 to prepare a card sliver, which was heat-treated at a temperature of 200° C. for 10 minutes with a circulating type hot-air dryer and then cut to a length of 20 mm. Both cut ends were fixed to a tensile tester and stress at the time of breaking at a speed of 0.2 m/min was measured. Measured values obtained by using the conjugated fibers in Comparative Example 2 were regarded as 100%, and values of other conjugated fibers were compared therewith as a basis and are shown below.

Crimp Modulus of Elasticity

The crimp modulus of elasticity of conjugated fibers was measured according to JIS L1074, and values of Comparative Example 2 were regarded as 100%. Values of other conjugated fibers were compared therewith as a basis and are shown below.

Three-dimensional Crimpability

Conjugated fibers were opened and carded to form a web, which was respectively cut lengthwise and crosswise to a length of 10 cm. The cut webs were heat-treated at a temperature of 140° C. for 10 minutes in a free state in a hot-air dryer to measure the number of crimps according to JIS L1074.

Opening Properties in Opening Step

Unopened parts in passing 100 g of conjugated fibers through an opening step with an opener were separated to measure the weight. The values obtained in Comparative Example 2 were taken as 100%, and weights of unopened parts of other conjugated fibers were compared therewith as a basis.

Wrapping Around Card Cylinder

When conjugated fibers were treated with a card, the feed of the fibers was stopped during the operation in a steady state. The fiber weight was measured from the time of stopping the feed of the fibers to the time when all the fibers were discharged was measured. Values obtained in Comparative Example 2 were regarded as 100%, and the fiber weights of other conjugated fibers were compared therewith as a basis and are shown below.

Unevenness of Card Web and Neps

Conjugated fibers were passed through a card, and the state of the web at the outlet of the card was visually judged. A case where unevenness of webs or neps were absent was judged to be excellent and a case where the unevenness of webs or neps was slight was judged to be good. Where there was great unevenness of webs or neps was judged to be bad.

Compression Resilience and Compression Durability after Heat Treatment

A blended web prepared in measuring the thermal adhesive strength among the filaments described above was laminated, formed into a flat plate shape and heat-treated at a temperature of 200° C. for 10 minutes in a circulation type hot-air dryer to prepare a fiber structure, regulated into the flat plate shape and having a density of 0.035 g/cm$^3$ and a thickness of 5 cm. The resulting fiber structure was compressed by 1 cm with a columnar rod having a flat undersurface and a cross-sectional area of 20 cm$^2$ to measure stress (initial stress), which was indicated as compression resilience. Measured values obtained by using conjugated fibers in Comparative Example 2 were taken as 100%, and values were compared therewith as a basis and are shown below. After measurement, the fiber structure was compressed under a load of 800 g/cm$^2$ for 10 seconds and then after removing the load, allowed to stand for 5 seconds. This cycle of compression-release procedures was repeated 360 times, and the compression stress was remeasured after 24 hours. The ratio (%) of change in the stress after the repetitive compression to the initial stress is recorded as the compression durability of the fiber structure. Values obtained by using the conjugated fibers in Comparative Example 2 were recorded as 100%, and values of other conjugated fibers were compared therewith as a basis and are shown below.

Hardness Unevenness after Heat Treatment

The surface of the fiber structure prepared in measuring the compression resilience and compression durability after the above-mentioned heat treatment was touched by hand to organoleptically evaluate the unevenness of hardness. A case where there was no unevenness of hardness was regarded as good, and a case where there were many unevennesses was considered as bad.

EXAMPLE 1 AND COMPARATIVE EXAMPLES 1–3

An acid component, which was a mixture of terephthalic acid with isophthalic acid at a ratio of 85/15 (mole %), was polymerized with butylene glycol, and 45% by weight of the resulting polybutylene terephthalate was further thermally reacted with 55% by weight of polybutylene glycol (molecular weight: 2,000) to provide a block copolymerized polyether polyester elastomer. This thermoplastic elastomer had an intrinsic viscosity of 1.3 and a melting point of 172° C. This thermoplastic elastomer was spun with polybutylene terephthalate using a conjugate spinneret (number of holes: 260) as shown in FIG. 3 so as to arrange the elastomer in the crescent part as indicated in FIG. 1 and provide a ratio of 50/50 expressed in terms of area ratio. Potassium lauryl phosphate as a finish oil in an amount of 0.05% by weight based on the filaments was applied thereto. Thereby, conjugated fibers in Example 1 were obtained. As Comparative Examples thereof, conjugate spinning of both the elastomer and the polybutylene terephthalate was carried out by using well-known spinnerets so as to provide fiber cross sections as illustrated in FIGS. 2(*a*) to 2(*c*). Both the polymers were joined into the side-by-side type in FIG. 2(*a*) and arranged so as to form the elastomer as the sheath component in FIG. 2(*b*) and as the sheath component of the eccentric sheath-core type in FIG. 2(*c*). These conjugated fibers were obtained as Comparative Examples 1, 2 and 3, respectively. The resulting undrawn yarns were drawn in 2-stage hot water baths at temperatures of 60° and 90° C. at draw ratios of 2.5 and 1.2 times, then oiled with potassium lauryl phosphate, mechanically crimped with a stuffing type crimper, dried at a temperature of 60° C. and further cut to a length of 64 mm. The resultant fibers had physical properties of a size of 9 denier and an oil pickup of 0.2% by weight. The conjugated fibers in Example 1 had a circumference ratio of 35%, a curvature radius ratio Cr of 1.2, a bending coefficient C of 1.73 and a wall thickness ratio D of 2.1 of the fiber cross section. Table 1 collectively shows fiber manufacturing properties, characteristics of the conjugated fibers, opening and carding performances and characteristics of the fiber structure. As for the fiber manufacturing properties, since cohesion frequently occurred in Comparative Examples 2 and 3, housing properties of undrawn yarns in subtow cans were bad; there was much yarn breakage in drawing and discharge properties from the crimper box were bad. In Example 1 and Comparative Example 1, these characteristics were good. As for the characteristics of the conjugated fibers, effects on prevention of undrawn yarn cohesion were slight in Comparative Examples 2 and 3, and many sticking fibers occurred to form extremely thick fibers. When the conjugated fibers were blended with matrix fibers to heat-treat card slivers, the number of constituent conjugated fibers was extremely small in effect and the thermal adhesive strength as the fiber structure was low. On the other hand, the cohesion of undrawn yarns was slight in Comparative Example 1 and Example 1, and the conjugated fibers were relatively uniformly dispersed in the interior of the fiber structure, resulting in a high thermal adhesive strength. Comparing Comparative Example 1 with Example 1, the thermal adhesive strength was higher in Example 1 and better than that in Comparative Example 1. As for the crimp characteristics of the conjugated fibers, Comparative Example 1 showed a low crimp modulus of elasticity due to the polyester component (P) assumed to have a semicircular and nearly flat cross-sectional shape. This adversely affects opening or carding performances in the opening step as mentioned below. Comparative Examples 2 and 3 and Example 1 showed crimp moduli of elasticity at about the same level. In Comparative Example 2, there was no o three-dimensional crimp ability of the conjugated fibers at all. Although there was crimp ability in Comparative Examples 1 and 2 and Example 1 because of the cross-sectional anisotropy, the three-dimensional crimp ability was low due to effects of cohesion in Comparative Example 3. Comparative Example 1 and Example 1 had high levels of three-dimensional crimp ability due to slight cohesion and sectional features possessed thereby. As for the opening and carding performances, many fibers sticking together unfavorably cause difficult opening, frequent wrapping around the cylinder of a card, great unevenness of webs and formation of many neps in Comparative Examples 2 and 3. Fibers were kept in a bundle shape due to the low crimp modulus of elasticity of the conjugated fibers in Comparative Example 1 and undesirably caused difficult opening, frequent wrapping around the cylinder of the card and great unevenness of card webs and formation of many neps. In Example 1, there were few sticking fibers and opening properties on opening were good with slight wrapping around the cylinder of the card, unevenness of webs and neps. Therefore, the characteristics of the conjugated fibers were good. As for the characteristics of the fiber structure, conditions of card webs were not good as mentioned above in Comparative Examples 1, 2 and 3. The thermal adhesive strength and compression resilience were low, and hardness unevenness was large, causing problems in practical use. In Example 1, both opening and carding performances were good, and the thermal adhesive strength in heat treatment was high. Since many three-dimensional crimps were developed simultaneously both compression resilience and compression durability were good to provide a good fiber structure with slight unevenness of hardness.

EXAMPLE 2

Procedures were followed in the same manner as in Example 1, except that the finish oil and draw-oil were changed from potassium lauryl phosphate in Example 1 into a dispersion of a polyester polyether block copolymer. Thereby, conjugated fibers were obtained to evaluate various characteristics. Furthermore, an aqueous dispersion prepared by blending a terephthalic acid/isophthalic acid/ethylene glycol/polyethylene glycol block copolymer [at a ratio of terephthalate unit:isophthalate unit=70:30 and a ratio of (terephthalate unit +isophthalate unit):polyethylene glycol unit=5:1; molecular weight of the polyethylene glycol:2,000 and average molecular weight of the block copolymer:10,000]with a surfactant potassium salt of POE (10 mole) nonyl phenyl ether sulfate at a ratio of 80:20 and an active component concentration of 10% was used as the block copolymer at this time. Table 2 shows the results obtained. Although slight cohesion occurred in spinning and bundling in Example 1, cohesion was eliminated to provide various good characteristics. The reasons why prevention of cohesion was further improved by applying an amorphous polyether/ester block copolymer to the conjugated fibers are assumed to be as follows: That is, the block copolymer was dispersed as fine particles and present in interstices among the filaments before or during the bundling of the undrawn yarns in spinning and this serves as rollers to reduce the friction among the filaments. It is presumed that the block copolymer was dispersed as fine particles in water and thereby contributed to an improvement in drawability without any recognizable cohesion phenomenon even when the conjugated fibers were heated at high temperatures enabling drawing. Table 2 collectively shows the results obtained .

EXAMPLES 3–8

Procedures were followed in the same manner as in Example 1, except that the through-put ratio of the polymers and specifications of the spinneret were changed n Example 1 to produce heat-bonding fibers having different cross-sectional shapes as shown in Table 3. Thereby, characteristics thereof were evaluated. As a result, in all the cases of Examples 3–8, undrawn yarns hardly stuck together as for the fiber manufacturing properties and opening properties and carding performances were good in a nonwoven fabric step. All the thermal adhesive strength among mutual filaments, compression resilience and compression durability of the fiber structure obtained by hot forming were good. Therefore, a good fiber structure with reduced hardness unevenness was obtained.

COMPARATIVE EXAMPLES 4–6

Procedures were followed in the same manner as in Example 1, except that the through-put ratio of the polymers and specifications of the spinneret were changed in Example 1 to produce heat-bonding fibers having different fiber cross-sectional shapes as shown in Table 4. The characteristics thereof were evaluated. As a result, in the cases of Comparative Examples 4–6, undrawn yarns frequently stuck together and opening properties and carding performances in the nonwoven fabric step were poor as for the fiber manufacturing properties. In producing the fiber structure, the thermal adhesive o strength among the mutual fibers was not high in carrying out the hot forming treatment, and both the compression resilience and the compression durability of the produced fiber structure were insufficient, resulting in a fiber structure with hardness unevenness and problems in practical use.

EXAMPLE 9

The heat-bonding conjugated fibers used in Example 1 in an amount of 30% based on the weight of fiber balls were blended with nonelastic crimped staple fibers in an amount of 70% based on the weight of the fiber balls and then passed through a roller card twice to provide blended bulky fibers. The resultant bulky fibers were then charged into a device having a blower connected through a duct to a fiber storage box and stirred with an air current in the blower for 30 seconds to afford balled fibers, which were subsequently transferred into the fiber storage box to melt the elastic thermoplastic elastomer while stirring the balled fibers with a weak air current at a temperature of 195° C. Thereby, heat-bonded spots were formed in the interior of the balled fibers, and air at ambient temperature was then fed into the fiber storage box to carry out a cooling treatment and provide highly elastic fiber balls. The resulting fiber balls were observed under a microscope to find nonelastic crimped polyester staple fibers at a possibility of 70% or above on the surfaces of the fiber balls. When the fiber balls were blown into a cushion quilt fabric with a blowing machine, no trouble was observed in blowing. The resultant cushion had a soft touch with good elasticity. The retention of hardness after compression 80,000 times was 55% and far higher than 35% of a cushion prepared simply by blowing fibers to the surfaces of which a silicone was applied thereinto or 32% of a cushion obtained by blowing fibers prepared simply by applying a segmented polymer emulsion of polyethylene terephthalate and polyethylene oxide to the surfaces thereof and solidifying the surfaces thereinto. The compressive hardness was 2.2 kg and higher than 0.6 kg of the cushion prepared simply by blowing the fibers to the surfaces of which the silicone was applied thereinto or 0.9 kg of the cushion obtained by blowing the fibers prepared by applying the segmented polymer emulsion to the surfaces thereof and solidifying the surfaces. The fiber bails were good and had high compression resilience despite a soft touch.

COMPARATIVE EXAMPLE 7

Procedures were followed in the same manner as in Example 9, except that a low-melting polyester polymer (melting point: 110° C.; intrinsic viscosity: 0.78) prepared by copolymerizing a dicarboxylic acid component, which was a mixture of terephthalic acid with isophthalic acid at a molar ratio of 60:40 based on the whole acid component with a glycol component that was a mixture of ethylene glycol with diethylene glycol at a molar ratio of 85:15 based on the whole diol component was used in place of the elastic thermoplastic elastomer in Example 9. Thereby, fiber balls were obtained. The resultant fiber balls were examined after tests of compression 80,000 times to find violently occurring peeling and breakage of heat-bonded spots, and the retention of hardness after compression 80,000 times was 15% and extremely bad. The fiber balls had no elasticity, and the handle was extremely bad.

TABLE 2

| | | | Example 1 | Comparative Example 1 | Comparative Example 2 | Comparative Example 3 | Example 2 |
|---|---|---|---|---|---|---|---|
| Fiber Manufacturing Property | 1) Housing property of undrawn yarn in subtow can in spinning | % | 200 | 210 | 100 | 105 | 250 |
| | 2) Yarn breakage in drawing | % | 55 | 53 | 100 | 98 | 3 |
| | 3) Discharge property of stuffing type crimper | — | Good | Good | Bad | Bad | Excellent |
| Characteristics of Conjugated Fiber | 4) Ability to prevent undrawn yarn from cohesion in spinning | — | Great | Great | Small | Small | Extremely great |

TABLE 2-continued

| | | | Example 1 | Comparative Example 1 | Comparative Example 2 | Comparative Example 3 | Example 2 |
|---|---|---|---|---|---|---|---|
| | 5) Interfacial adhesive strength between elastomer/polyester | | High | High | High | High | High |
| | 6) Thermal adhesive strength among filaments | % | 210 | 160 | 100 | 105 | 270 |
| | 7) Crimp modulus of elasticity | % | 98 | 62 | 100 | 96 | 98 |
| | 8) Three-dimensional crimpability | Peaks/ inch | 32 | 37 | 0 | 12 | 43 |
| Opening and Carding Performance | 9) Opening property in opening step | % | 51 | 86 | 100 | 97 | |
| | 10) Wrapping around card cylinder | % | 50 | 84 | 100 | 99 | 0 |
| | 11) Unevenness of card web | — | Good | Bad | Bad | Bad | Excellent |
| | 12) Card web nep | — | Good | Bad | Bad | Bad | Excellent |
| Characteristics of Fiber Structure | 13) Compression resilience after heat treatment | | 82 | 49 | 100 | 93 | 110 |
| | 14) Hardness unevenness after heat treatment | | Small | Small | Great | Great | Extremely small |
| | 15) Compression durability after heat treatment | | 120 | 106 | 100 | 105 | 130 |

TABLE 3

| Each Parameter of Fiber Cross section | Example 1 | Example 2 | Example 3 | Example 4 | Example 5 | Example 6 | Example |
|---|---|---|---|---|---|---|---|
| Area Ratio (P:E) (%) | 50:50 | 50:50 | 25:75 | 75:25 | 60:40 | 30:70 | 40:60 |
| Circumference Ratio (%) | 35 | 35 | 47 | 27 | 30 | 45 | 38 |
| Curvature radius ratio $C_r$ ($r_1/r_2$) | 1.3 | 1.25 | 1.1 | 1.9 | 1.5 | 1.2 | 1.2 |
| Bending coefficient C ($L_2/L$) | 1.73 | 1.73 | 2.3 | 1.2 | 1.5 | 2.1 | 2.2 |
| Wall Thickness Ratio | 2.1 | 2.1 | 2.9 | 1.2 | 1.8 | 2.7 | 2.5 |

TABLE 4

| Each Parameter of Fiber Cross Section | Comparative Example 1 | Comparative Example 2 | Comparative Example 3 | Comparative Example 4 | Comparative Example 5 | Comparative Example 6 |
|---|---|---|---|---|---|---|
| Area Ratio (P:E) (%) | 50:50 | 50:50 | 50:50 | 30:70 | 40:60 | 35:65 |
| Circumference Ratio (%) | 50 Side-by side type | 0 Sheath-core type | 5 Eccentric Sheath-core type | 45 | 38 | 42 |
| Curvature radius ratio $C_r$ ($r_1/r_2$) | — | 1.4 | 1.4 | 1.2 | 1.25 | 1.23 |
| Bending coefficient C ($L_2/L$) | 1 | — | — | 2.1 | 2.2 | 2.15 |
| Wall Thickness Ratio | 1 | 4.8 | 2.4 | 2.7 | 2.5 | 2.6 |

INDUSTRIAL UTILITY

Heat-bonding conjugated fibers of this invention comprising the crystalline component (E) as one component achieves simultaneously an elimination of cohesion phenomenon which inevitably occurs in producing conjugated fibers and inhibits the handleability of fibers, process characteristics and further even the ,essential adhesion with the interfacial adhesive strength between the polymers and essential bonding performances and crimp modulus. The heat-bonding conjugated fibers can be used as fibers for various cushioning materials, for example, furniture, beds, wadding, beddings, seat cushions, wadding of quilting wear, nonwoven fabrics for sanitary and medical materials, fabrics for clothes, carpets, vehicular interior trims and the like.

Furthermore, since fiber balls using the heat-bonding conjugated fibers of this invention are excellent in blowing characteristics and the resultant cushioning material and wadding are excellent in bulkiness and compression durability and have high elasticity and soft handle, the fiber balls can be suitably used as wadded materials such as cushions, pillows and the like.

What is claimed is:

1. Heat-bonding conjugated fibers comprising a crystallinethermoplastic elastomer E and nonelastic crystalline polyester P having a higher melting point than that of said elastomer E arranged at an area ratio E:P of 20:80 to 80:20 in a circular fiber cross section, said fibers having the cross section and surface being specified by the following requirements (1) to (5):

(1) said elastomer E is arranged in a crescent shape formed by two circular arcs having different curvature radii and a curve having a larger curvature radius $r_1$ forms a part of the outer circumference line in the fiber cross section;

(2) said polyester P is joined to said elastomer along a curve having a smaller curvature radius $r_2$ in the two curves forming the crescent shape and, on the other hand, the curve having the larger curvature radius $r_1$ forms a part of the fiber surface in a circular arc form so as to provide the outer circumference line within a range of a circumference ratio R of 25 to 49% in the fiber cross section, wherein the circumference ratio R is defined by the ratio of the outer circumference line $L_3$ to the whole circumference $L_1+L_3$ in the circle having the radius $r_1$ in FIG. 1 and calculated by an equation $R=\{(L_3)/(L_1+L_3)\times 100(\%)\}$;

(3) the curvature radius ratio Cr, which is the ratio $r_1/r_2$ of the curvature radius $r_1$ to the. curvature radius $r_2$, wherein said curvature radius ratio Cr is greater than 1 but not greater than 2;

(4) the bending coefficient C of the curve having the curvature radius $r_2$ is within the range of 1.1 to 2.5 with the proviso that the bending coefficient C is defined by the ratio of the length of the circular arc $L_2$ having the radius $r_2$ to the length L between contact points $P_1$–$P_2$ formed by the circumference of the circle having the radius $r_1$ and the circular arc ($L_2$) in FIG. 1 and calculated by an equation $C=(L_2)/(L)$ and (5) a wall thickness ratio D of said elastomer E to said polyester P is within a range of 1.2 to 3, wherein the wall thickness ratio D is defined by a ratio of the length LP of a polyester component P in the direction of a straight line passing through the center of the circle having the radius $r_1$ and the center of the circle containing the circular arc having the radius $r_2$ as a part thereof to the length $L_E$ of the elastomer component E in FIG. 1 and calculated by an equation $D=(L_P)/(L_E)$.

2. The heat-bonding conjugated fiber according to claim 1, wherein the melting point of said elastomer E is within the range of 100° to 220° C.

3. The heat-bonding conjugated fiber according to claim 1, wherein the melting point of said polyester P is higher than that of said elastomer E by 10° C. or more.

4. The heat-bonding conjugated fibers according to claim 2, wherein said elastomer E is a polyester elastomer comprising a main acid component of 40 to 100 mole % of terephthalic acid and 0 to 50 mole % of isophthalic acid, a main glycol component comprising of 1,4-butanediol and a main soft segment component of a poly(alkylene oxide) glycol having an average molecular weight of 400 to 5000 in an amount thereof copolymerized within the range of 5 to 80% by weight; said polyester elastomer E having an intrinsic viscosity of 0.6 to 1.7.

5. The heat-bonding conjugated fiber according to claim 3, wherein said component P is polybutylene terephthalate.

6. The heat-bonding conjugated fiber according to claim 1, comprising said heat-bonding conjugated fiber and an oil consisting essentially of an amorphous polyether/ester block copolymer in an amount within the range of 0.02 to 5.0% by weight based on the fiber weight on the surface of said fiber.

* * * * *

UNITED STATES PATENT AND TRADEMARK OFFICE

CERTIFICATE OF CORRECTION

PATENT NO. : 5,677,057
DATED : October 14, 1997
INVENTOR(S) : Mikio TASHIRO, Shigeru HIRANO, Masayuki HAYASHI, Kazunori ORII, Makoto YOSHIDA It is certified that error appears in the above-identified patent and that said Letters Patent is hereby corrected as shown below:

On the face of the patent, delete:

" [22] Filed: Aug.6, 1998 ".

And replace with:

-- [22] PCT Filed: Dec. 25, 1995

[86] PCT No.: PCT/JP95/02665

§ 371 Date: July 3, 1997

§ 102(e) Date: July 3, 1997

[87] PCT Pub. No.: WO97/23670

PCT Pub. Date: July 3, 1997 --.

Signed and Sealed this

Seventh Day of September, 1999

*Attest:*

Q. TODD DICKINSON

*Attesting Officer*

*Acting Commissioner of Patents and Trademarks*